US011149365B2

(12) United States Patent
Fiedler et al.

(10) Patent No.: US 11,149,365 B2
(45) Date of Patent: Oct. 19, 2021

(54) BRAIDING MACHINE

(71) Applicant: MASCHINENFABRIK NIEHOFF GMBH & CO. KG, Schwabach (DE)

(72) Inventors: Holger Fiedler, Spalt (DE); Wolfgang Stadler, Hilpoltstein (DE)

(73) Assignee: MASCHINENFABRIK NIEHOFF GMBH & CO. KG, Schwabach (DE)

( * ) Notice: Subject to any disclaimer, the term of this patent is extended or adjusted under 35 U.S.C. 154(b) by 124 days.

(21) Appl. No.: 16/488,883

(22) PCT Filed: Feb. 20, 2018

(86) PCT No.: PCT/EP2018/054173
§ 371 (c)(1),
(2) Date: Aug. 26, 2019

(87) PCT Pub. No.: WO2018/153870
PCT Pub. Date: Aug. 30, 2018

(65) Prior Publication Data

US 2020/0024778 A1 Jan. 23, 2020

(30) Foreign Application Priority Data

Feb. 27, 2017 (DE) ..... 102017203161.1

(51) Int. Cl.
*D04C 3/40* (2006.01)
*D04C 3/14* (2006.01)
*D04C 3/38* (2006.01)

(52) U.S. Cl.
CPC ..... *D04C 3/40* (2013.01); *D04C 3/14* (2013.01); *D04C 3/38* (2013.01)

(58) Field of Classification Search
CPC ... D04C 3/14; D04C 3/38; D04C 3/40; D04C 3/42
See application file for complete search history.

(56) References Cited

U.S. PATENT DOCUMENTS 2,258,018 A * 10/1941 King ..... D04C 3/18 87/22
4,266,461 A * 5/1981 Molitors ..... D04C 3/40 226/44

(Continued)

FOREIGN PATENT DOCUMENTS

CN 201447562 5/2010
CN 203700706 7/2014

(Continued)

OTHER PUBLICATIONS

Official Action for Russia Patent Application No. 2019130335/03, dated Jan. 26, 2021, 8 pages.

(Continued)

*Primary Examiner* — Shaun R Hurley
(74) *Attorney, Agent, or Firm* — Sheridan Ross P.C.

(57) ABSTRACT

The present invention relates to a braiding machine and a method for controlling a braiding machine of this kind. An exemplary embodiment of the braiding machine has a plurality of braided-material carriers, a drive and a control device. The plurality of braided-material carriers are arranged around a common braiding centre of the braiding machine and are each designed to carry a braided material that is to be braided in the common braiding centre. The drive is designed to drive the plurality of braided-material carriers such that they move around the common braiding centre. The control device is designed to control the drive such that a centrifugal force acting on at least one of the braided-material carriers remains nearly constant.

17 Claims, 9 Drawing Sheets

(56) References Cited

U.S. PATENT DOCUMENTS

| | | | | |
|---|---|---|---|---|
| 4,716,807 | A | 1/1988 | Fischer | |
| 4,903,473 | A * | 2/1990 | Classen | D07B 7/02 57/15 |
| 5,111,646 | A * | 5/1992 | Lange | H01B 13/0841 242/441.2 |
| 6,453,789 | B2 * | 9/2002 | Bettger | D04C 3/18 87/33 |
| 10,422,059 | B2 * | 9/2019 | Owen | D04C 3/48 |
| 2015/0275409 | A1 * | 10/2015 | Owen | D04C 3/38 87/8 |
| 2020/0010986 | A1 * | 1/2020 | Falkenberg | D04C 3/06 |
| 2020/0277713 | A1 * | 9/2020 | Shibuya | D01H 1/14 |

FOREIGN PATENT DOCUMENTS

| | | |
|---|---|---|
| DE | 2162170 | 6/1973 |
| DE | 2903807 | 8/1980 |
| DE | 4127678 | 3/1992 |
| DE | 102005058223 | 6/2007 |
| RU | 2519888 | 6/2014 |
| WO | WO 01/53583 | 7/2001 |

OTHER PUBLICATIONS

International Search Report prepared by the European Patent Office dated Mar. 28, 2018, for International Application No. PCT/EP2018/054173, 2 pages.

Translation of International Preliminary Report on Patentability for International (PCT) Patent Application No. PCT/EP2018/054173, dated Aug. 29, 2019, 7 pages.

Official Action with English Translation for China Patent Application No. 201880027926.6, dated Jul. 31, 2020, 16 pages.

* cited by examiner

PRIOR ART

BRAIDING MACHINE

CROSS REFERENCE TO RELATED APPLICATIONS

This application is a national stage application under 35 U.S.C. 371 and claims the benefit of PCT Application No. PCT/EP2018/054173 having an international filing date of 20 Feb. 2018, which designated the United States, which PCT application claimed the benefit of German Patent Application No. 10 2017 203 161.1 filed 27 Feb. 2017, the disclosures of each of which are incorporated herein by reference in their entireties.

BACKGROUND OF THE INVENTION

The present invention relates to a braiding machine and a method for controlling a braiding machine of this kind.

Braiding machines for braiding a braiding material are known in the prior art. At present, braiding machines are operated at a constant speed, which may not exceed a maximum speed. The maximally permissible speed is significantly restricted by the maximally permitted load of the machine, which is a result in turn of the maximally permissible centrifugal force.

A high-speed braiding machine is known from DE 21 62 170 A1 for braiding stranded material by means of filamentous braiding material in the form of wires or tapes of organic and inorganic material using two counter-rotating bobbin carriers.

Furthermore, a braiding machine is known from DE 10 2005 058 223 A1, in particular for braiding wire mesh or textile fabrics. The braiding machine has a first bobbin carrier set and at least a second bobbin carrier set, which perform a movement relative to one another during braiding, wherein at least one of the bobbin carrier sets is guided along a circular guide track.

During a braiding process, braiding material provided continuously by braiding-material carriers is supplied and braided. The mass of the braiding-material carriers therefore changes during a braiding process. The load of the braiding machine also changes in consequence. Today's braiding machines are therefore mostly operated at a speed which, although it protects the braiding machines from overload, does not take account to a sufficient extent of the possibility of productivity increases.

In view of this, a need exists to provide a braiding machine and a method for controlling a braiding machine that make an increase in productivity possible.

SUMMARY OF THE INVENTION

A first aspect of the present invention relates to a braiding machine. The braiding machine has a plurality of braiding-material carriers, a drive and a control device. The braiding-material carriers are arranged around a common braiding centre of the braiding machine. The braiding-material carriers are each designed to carry a braiding material that is to be braided in the common braiding centre. The drive is designed to drive the plurality of braiding-material carriers such that they move around the common braiding centre. The control device is designed to control the drive such that a centrifugal force acting on at least one of the braiding-material carriers remains at least nearly constant.

The drive can be designed, for example, to drive the plurality of braiding-material carriers such that they turn around the common braiding centre/rotate around the common braiding centre.

A second aspect of the invention relates to a method for controlling a braiding machine. The braiding machine has a plurality of braiding-material carriers, a drive and a control device. The plurality of braiding-material carriers are arranged around a common braiding centre of the braiding machine. The braiding-material carriers are each designed to carry a braiding material that is to be braided in the common braiding centre. The method describes driving of the plurality of braiding-material carriers such that they move around the common braiding centre. The method further describes controlling of the drive such that a centrifugal force acting on at least one of the braiding-material carriers remains at least nearly constant.

The plurality of braiding-material carriers can be driven in such a way, for example, that they turn around the common braiding centre/rotate around the common braiding centre.

According to the invention, the drive is controlled by the control device such that a centrifugal force acting on at least one of the braiding-material carriers remains/is kept at least nearly constant. During a braiding process, braiding material carried by the braiding-material carriers is braided constantly. The degree of filling of the fill carriers and thus the mass of the braiding-material carriers change, therefore, during a braiding process. In contrast to traditional braiding machines, no constant speed is set, but an at least nearly constant centrifugal force is maintained. The speed does not have to be kept constant, but can be increased, for example, if the mass of the at least one braiding-material carrier decreases, as long as the centrifugal force acting on this remains at least nearly constant. As the mass decreases, an increase in the speed leads to an a least nearly constant centrifugal force acting on the at least one braiding-material carrier. An increase in the speed leads to an increase in productivity.

The present invention is explained below for reasons of clarity with a primary focus on the braiding machine according to the first aspect, wherein the following considerations apply accordingly to the method for controlling the braiding machine according to the second aspect.

The braiding-material carriers can run in a circle around the common braiding centre, i.e. be arranged along a circumference around the common braiding centre. The braiding-material carriers can be arranged each at a uniform distance from one another in a circumferential direction around the common braiding centre. The braiding-material carriers can be bobbins on which the braiding material can be wound, for example. The braiding-material carriers can be arranged at a uniform distance from the braiding centre in a radial direction. The radial distance of the braiding-material carriers from the braiding centre can be uniform/unchanging or variable. The braiding-material carriers can be provided with a quantity of braiding material that is identical or at least in some cases varies from one another. The braiding material provided respectively by the braiding-material carriers is braided together in the braiding centre. The braiding centre can also be described as the braiding axis of the braiding machine. The braiding centre can lie parallel to the longitudinal axis of the braiding machine or correspond to this.

According to a first possible exemplary embodiment, it is conceivable that the braiding-material carriers are mounted or arranged on a common carrier. Due to movement, e.g. rotation, of the common carrier, the movement described of the braiding-material carriers around the common braiding centre can be executed. In addition, an immobile braiding-material carrier can be provided, so that the braiding material provided by the plurality of braiding-material carriers and the braiding material provided by the immobile braiding-material carrier can be braided with one another in a known manner. In this case the aspects and details described herein relate to the movement of the braiding-material carriers mounted or arranged on the common carrier, for example. According to a second possible exemplary embodiment, it is conceivable that the plurality of braiding-material carriers are mounted or arranged on a first common carrier and other braiding-material carriers are mounted or arranged on a second common carrier. The two common carriers can be designed in one specific configuration as bobbin sets or rings. The two carriers can each be driven by a common drive or by separate/different drives. A braiding process can take place in a known manner, for example by opposed movement, e.g. opposed rotation, of the two common carriers. The aspects and details described herein can relate to the movement of the braiding-material carriers mounted or arranged, for example, on the first common carrier. In addition, the aspects and details described herein can relate to the movement of the braiding-material carriers mounted or arranged, for example, on the second common carrier. According to a specific realisation, an external so-called lower ring, which is provided with braiding-material carriers, can move counter to an internal so-called upper ring, which is likewise provided with braiding-material carriers. The aspects and details described herein can relate to the lower ring and/or the upper ring of the braiding machine.

The braiding material can be any conceivable stranded or elongated material that is suitable for a braiding process. With the aid of the braiding machine, therefore, different braids of stranded material such as wires or textile fibres can be manufactured, for example in the form of braided hoses or litz braids and/or for braiding around a cable with a wire braid, for example. The braiding machine can be a wire braiding machine especially suitable for braiding wires, for example. The braiding machine can be a rotary braiding machine.

A braiding process can be understood as a complete process for manufacturing a braided product. It is further conceivable that a braiding process can be understood as a process lasting from the start-up of the braiding machine to the stopping of the braiding machine. The braiding machine is stopped, for example, if one or more of the braiding-material carriers run out and are replaced by a full braiding-material carrier, i.e. one filled completely with braiding material.

During a braiding process, the drive can be controlled by the control device, for example, such that the centrifugal force acting on all of the braiding-material carriers remains at least nearly constant. The term control can be understood herein such that it comprises open- and/or closed-loop control.

As described, braiding material carried by the braiding-material carriers is braided constantly during a braiding process. The filling level of the fill carriers and thus the mass of the braiding-material carriers therefore change during a braiding process. The filling level and thus the mass of the braiding-material carriers can coincide. If the centrifugal force acting on one of the braiding-material carriers is kept constant in this case, the centrifugal force acting on each of the other braiding-material carriers is automatically kept constant at the same value.

According to one exemplary embodiment, the drive can be designed to drive the plurality of braiding-material carriers such that they rotate at an adjustable speed around the common braiding centre. The control device can be designed to adjust the adjustable speed such that the centrifugal force acting on the at least one of the braiding-material carriers remains at least nearly constant. For example, the control device can be designed to adjust the adjustable speed such that the centrifugal force acting on all braiding-material carriers remains at least nearly constant. The control device can be designed to control the drive of the braiding machine such that the plurality of braiding-material carriers rotate around the common braiding centre at the adjusted speed. The drive can receive appropriate control instructions from the control device for this. The drive can drive the braiding-material carriers accordingly based on the control instructions.

According to a variant of this exemplary embodiment, the drive can be designed to drive the plurality of braiding-material carriers such that they rotate at an adjustable angular velocity or velocity around the common braiding centre.

The control device can be designed to adjust the adjustable angular velocity or velocity such that the centrifugal force acting on the at least one of the braiding-material carriers remains at least nearly constant. For example, the control device can be designed to adjust the adjustable angular velocity or velocity such that the centrifugal force acting on all of the braiding-material carriers remains at least nearly constant.

Due to the exemplary embodiment and its variant, in the event of a change in the mass of the at least one braiding-material carrier, the centrifugal force acting on this is kept at least nearly constant in that the speed, angular velocity or velocity is adjusted. This represents an efficient and simple possibility for keeping the centrifugal force at least nearly constant. As explained, braiding material provided constantly by the braiding-material carriers is braided during a braiding process. The filling level of the fill carriers and thus the mass of the braiding-material carriers change, therefore, during a braiding process. In contrast to conventional braiding machines, the speed, angular velocity or velocity is not set and kept constant, but can be increased, for example, if the mass of the at least one braiding-material carrier decreases, as long as the centrifugal force acting on the at least one braiding-material carrier remains at least nearly constant. An increase in the speed, angular velocity or velocity leads to an increase in productivity.

Even if reference is made herein to the speed instead of the angular velocity or velocity, these statements apply accordingly also to the angular velocity or velocity.

The control device can be designed to adjust the adjustable speed several times/repeatedly during a braiding process. The adjustable speed can be adjusted at set or variable time intervals during a braiding process. Let it be said purely by way of example here that the adjustable speed is adjusted continuously/progressively during a braiding process. Due to the repeated, for example continuous, adjustment of the speed, the drive can be controlled more precisely. Since the centrifugal force is a quadratic function of the speed, the maximally permissible machine speed rises when the centrifugal force is constant and the mass steadily decreases. The speed can thus be increased to raise productivity. The repeated adjustment of the speed guarantees that the speed can be increased repeatedly during a braiding process. This augments the productivity increase during the braiding process.

The control device can be designed to control the drive such that a centrifugal force acting maximally on at least one of the braiding-material carriers remains at least nearly constant. For example, the control device can be designed to adjust the adjustable speed such that a centrifugal force acting maximally on at least one of the braiding-material carriers remains at least nearly constant.

The braiding machine is thereby designed for the maximally acting centrifugal force. This guarantees more reliable protection against overload of the braiding machine.

The control device can be designed to control the drive as a function of the mass of at least one of the braiding-material carriers. For example, the control device can be designed to adjust the adjustable speed as a function of the mass of at least one of the braiding-material carriers.

The mass of at least one of the braiding-material carriers is taken into account by this in the control of the drive, such as e.g. in the adjustment of the speed. As explained, during a braiding process, braiding material provided constantly by the braiding-material carriers is braided. The filling level of the fill carriers and thus the mass of the braiding-material carriers therefore change during a braiding process. By considering the mass of the at least one braiding-material carrier, the speed can be adjusted according to the changed mass, in order to keep the centrifugal force acting on the at least one braiding-material carrier constant.

Various implementations are conceivable as to how the control of the drive can take place based on the mass of at least one of the braiding-material carriers.

According to a first possible implementation, it is conceivable that only the mass of a single one of the braiding-material carriers is determined and taken into account in adjustment of the speed. This procedure can be sufficient if it is known, for example, that all braiding-material carriers have the same mass. The braiding-material carriers have e.g. the same mass if the braiding machine was newly commissioned or all braiding-material carriers were exchanged together.

According to a second possible implementation, the mass of all braiding-material carriers is determined, for example. In accordance with a first variant of the second possible implementation, a mean or median value can be formed from the determined masses, for example. The determined mean or median value of the masses can then be considered in the adjustment of the speed.

According to a second variant of the second possible implementation, the control device can be designed to control the drive as a function of the mass of the braiding-material carrier with the greatest mass of the plurality of braiding-material carriers. For example, the control device can be designed to adjust the adjustable speed as a function of the mass of the braiding-material carrier with the greatest mass of the plurality of braiding-material carriers. For this the control device can determine the mass of all braiding-material carriers and select the mass of the braiding-material carrier with the greatest mass by comparison and take it into account for control of the braiding machine, e.g. for the adjustment of the adjustable speed. The adjustable speed can be selected such that a maximally permitted centrifugal force of the braiding machine is not exceeded.

The mass of the braiding-material carriers can be regarded as a quadratic function of a ring surface area. The ring surface area can be the path on which the braiding-material carriers move around the braiding centre. If the speed is controlled according to the braiding-material carrier with the highest mass, the mass of the remaining bobbins decreases faster accordingly. In the case of at least partially different filling levels of the braiding-material carriers, therefore, the mass of the other braiding-material carriers with a lower filling level does not remain constant.

Due to the open-/closed-loop control according to the braiding-material carrier with the highest mass, an accurate and simple option is provided for retaining the centrifugal force and, in the case of decreasing mass, increasing the speed.

The filling level and thus the mass of at least some of the braiding-material carriers of the braiding machine can differ. Because the greatest mass of all braiding-material carriers is considered, the braiding machine is designed for the maximally acting centrifugal force. This guarantees more reliable protection against overload of the braiding machine. This means that to protect against overload and maloperation, the adjustable speed can be determined from the maximally filled braiding-material carrier. Due to this, the constant centrifugal force can also lie below the maximally permitted centrifugal force or be selected in such a way, i.e. below the centrifugal force that exists on known braiding machines at constant speed. Thus not only can a productivity increase be achieved over the running time of the machine, but also a reduction in the maximum machine load.

The open-/closed-loop control of the braiding machine can take place in a linear manner, for example. The braiding process can be started at a speed here that e.g. at least nearly corresponds to the permissible actual speed of the braiding machine. The braiding machine can be controlled in an open/closed loop below such that it runs at a speed rising linearly, for example, until a maximum speed, e.g. a maximally permitted speed at a defined filling of the at least one braiding-material carrier, is reached. For example, the braiding machine can start at a starting speed and attain a maximum speed at a filling level of 60% of the at least one braiding-material carrier, for example, after a certain time. This can take place controlled by means of a sensor or also uncontrolled with a fixed setting.

The mass of the braiding-material carriers can be determined in different ways. According to a first conceivable configuration, the control device can estimate the mass of the at least one braiding-material carrier based on operating parameters of the braiding machine and/or information about the at least one braiding-material carrier. For example, the control device can consider for this the time at which the braiding-material carrier was mounted on the braiding machine in a full state, the speed at which the braiding machine ran since this time and the starting mass that the braiding-material carrier had in the full state. The current mass of the braiding-material carrier can be deduced from these or similar parameters. The mass of the at least one braiding-material carrier can be estimated by this without any other components.

According to a second conceivable configuration, the braiding machine can have at least one sensor. The sensor can be designed to detect the filling level of at least one of the braiding-material carriers with braiding material. On a braiding machine with a first common carrier of braiding-material carriers and a second common carrier of braiding-material carriers, for example an external lower ring and an internal upper ring, the filling level of at least one braiding-material carrier of the first common carrier and/or of at least one braiding-material carrier of the second common carrier can be detected, for example. Let it be stated purely by way of example here that on a braiding machine with two bobbin rings, e.g. only the filling level of at least one braiding-material carrier of the upper ring is measured (the upper ring is usually more critical for the braiding process) or also the filling level of at least one braiding-material carrier of both rings (upper and lower ring) is detected. As stated above, control can be carried out e.g. according to the maximally filled braiding-material carrier.

According to one exemplary embodiment, it is conceivable that a single sensor is fixedly provided, past which the plurality of braiding-material carriers move due to their rotation around the common braiding centre. The one sensor can accordingly take consecutive measurements to detect the respective filling level of the braiding-material carriers from the measurements. The filling level can be understood as the percentage of braiding material with which the braiding-material carrier is actually filled compared with a braiding-material carrier completely filled with braiding material. The exemplary embodiment can be e.g. refined in that a further sensor is provided, which can be provided for detecting the position of the braiding-material carriers. Thus two sensors, for example, can be provided according to the exemplary embodiment. These two sensors can perform corresponding measurements on each of the braiding-material carriers. For example, a first of the two sensors can detect the filling level of the at least one braiding-material carrier, for example of each braiding-material carrier, by way of a distance measurement. A second of the sensors can detect the position of the at least one braiding-material carrier and instruct the first sensor to start the distance measurement, e.g. by outputting a signal. It can thus be ensured that the distance measurement always takes place at the same place and per braiding-material carrier. According to another exemplary embodiment, a plurality of sensors can be provided for detecting the filling level. For example, a number of sensors can be provided that matches the number of braiding-material carriers. It is conceivable that each of these sensors is associated with a braiding-material carrier, for example, such that it always only undertakes measurements to detect the filling level of this one braiding-material carrier. The required measurements can thereby be carried out simultaneously in each case.

The at least one sensor can be a distance sensor, i.e. a sensor that is designed to carry out distance measurements. This can be an optical sensor. The sensor can be designed, for example, to detect a distance by means of laser. It is not the mass of the braiding-material carrier that can be determined directly by means of this sensor, therefore, but the distance of the sensor from the braiding-material carrier. Since braiding material is provided continuously by the braiding-material carrier during the braiding process, the filling level of the braiding-material carrier decreases. This loss of filling level/decrease in filling level, e.g. diameter loss/diameter decrease, of the braiding-material carrier can be detected by means of the sensor per distance measurement. The current mass can be calculated from the distance measurement, more precisely from the filling level deduced by means of the distance detection. This results from the fact that the mass of the braiding-material carrier is dependent on its filling level and vice-versa.

The sensor can be arranged on or in the braiding machine such that all of the braiding-material carriers pass it on their rotation around the common braiding centre. The sensor can be mounted, for example, statically on the frame of the braiding machine outside the moving braiding-material carriers, for example outside the rotating rings.

Alternatively to the configuration of the sensor e.g. as a distance sensor for detecting the filling level of the braiding-material carrier and the indirect determination of the mass of the braiding-material carrier from the filling level detected, it is conceivable to equip the at least one braiding-material carrier, e.g. each braiding-material carrier, with a force sensor. The centrifugal force acting in each case can then be measured directly by means of the force sensor. The centrifugal force acting on the respective braiding-material carrier can be determined by this in a swift and easy manner.

The at least one sensor can be designed to detect the filling level of at least one of the braiding-material carriers repeatedly during a braiding process. The filling level can be detected at fixed or variable time intervals. For example, the filling level of the at least one braiding-material carrier can be determined progressively/continuously.

The information recorded by the at least one sensor regarding the filling level of the at least one braiding-material carrier can be communicated to the control device. For example, this information can be forwarded continually, for example at fixed or variable time intervals, by the at least one sensor to the control device or be retrieved by the control device from the at least one sensor. Forwarding of the information by the sensor to the control device can take place e.g. continuously.

The braiding machine can be controlled more precisely by this. For example, the speed can be increased more frequently. This leads to a further rise in productivity.

The control device can be designed to deduce the mass of the at least one braiding-material carrier from the detected filling level of the at least one braiding-material carrier. The control device can take the mass of the unfilled braiding-material carrier into consideration for this in addition to the filling level. By determining the mass from the filling level of the at least one braiding-material carrier, a simple and accurate possibility is provided for determining the mass of the at least one braiding-material carrier, in order to take this into account for the control of the drive, such as e.g. adjustment of the speed.

By using the at least one sensor, a possibility is provided for determining the mass of the at least one braiding-material carrier, e.g. of all of the braiding-material carriers, quickly and accurately. The braiding machine can be controlled more precisely by this.

According to one exemplary embodiment, the at least one sensor can be designed to detect the filling level of all braiding-material carriers continually during a braiding process. From this the control device can determine the mass of all braiding-material carriers continually. Based on the mass of all braiding-material carriers, the control device can control the drive, such as e.g. adjusting the speed. For example, the control device can adjust the speed based on a mean value of all determined masses. Alternatively the control device can adjust the speed continually based on the highest of all determined masses.

The braiding machine can further have at least one unbalance sensor. The at least one unbalance sensor can be designed to determine an imbalance of the plurality of braiding-material carriers on rotation around the common braiding centre. Since the braiding-material carriers can be filled to varying levels, an imbalance may be present in the braiding machine. Since the bobbins empty uniformly, the weight differences and consequently also the imbalance remain. When the speed is increased, the imbalance also increases. An increased speed could consequently result in stronger vibration. The unbalance sensor can be provided to monitor this. Vibrations can have an influence on the product quality and on the durability of the machine. Unbalance sensors are known from the prior art and are used in washing machines, for example.

The control device can be designed to take account of the determined imbalance when controlling the drive. For example, the control device can be designed to take account of the determined imbalance in adjustment of the adjustable speed. If the control device determines, for example, that the adjusted speed would lead or actually leads to an imbalance that exceeds a predetermined limit value, the control device can instead adjust the speed such that it lies exactly at or below the limit value.

The method described can be executed entirely or partly by means of a computer program. A computer program product with program code sections for executing the method can thus be provided. The computer program can be stored on a computer-readable storage medium or in the braiding machine. If the program code sections of the computer program are loaded into a calculator, computer or processor (for example, a microprocessor, microcontroller or digital signal processor (DSP)), or run on a calculator, computer or processor, they can cause the computer or processor to execute one or more steps or all steps of the method described herein.

Even if some of the aspects and details described above were described in relation to the braiding machine, these aspects can also be realised in a corresponding manner in the method for controlling the braiding machine or a computer program supporting or implementing the method.

BRIEF DESCRIPTION OF THE DRAWINGS

The present invention is to be explained further by means of figures. These figures show schematically.

DETAILED DESCRIPTION

Specific details are set out in the following, without being restricted to these, in order to supply a complete understanding of the present invention. However, it is clear to a person skilled in the art that the present invention can be used in other exemplary embodiments, which may diverge from the details set out below.

It is also clear to the person skilled in the art that the explanations set out below can be/become implemented using hardware circuits, software means or a combination thereof. The software means can be connected to programmed microprocessors or a general calculator, computer, an ASCI (application specific integrated circuit) and/or DSPs (digital signal processors). It is also clear that even if the following details are described in relation to a method, these details can also be realised in a suitable equipment unit, a computer processor or a memory connected to a processor, wherein the memory is provided with one or more programs that carry out the method when they are executed by the processor.

Figure 1A:
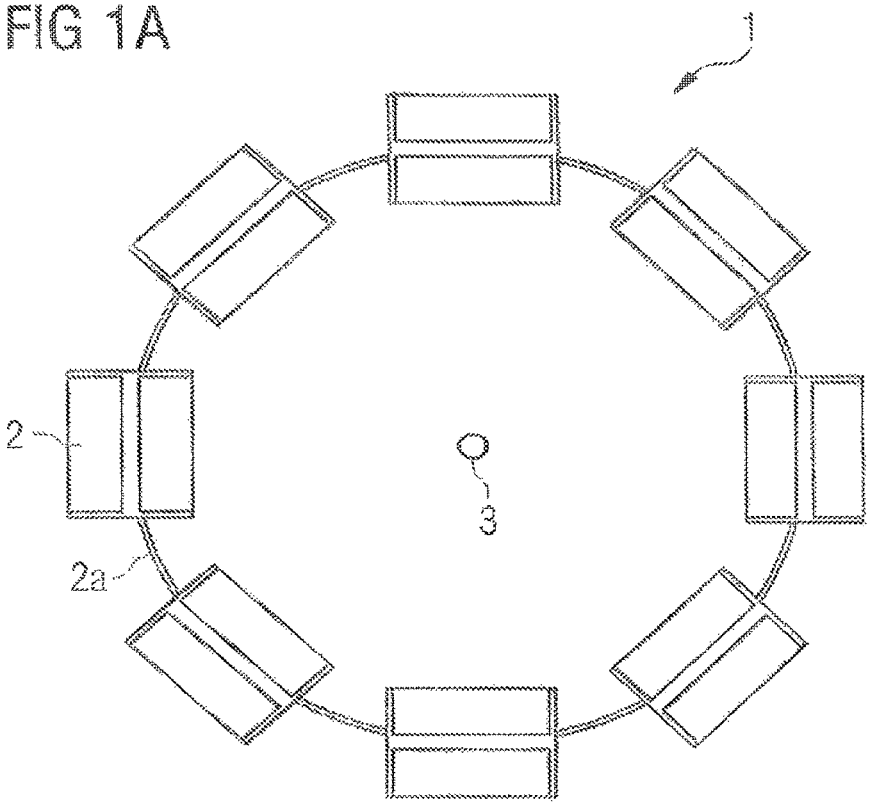
FIG. 1*a* a braiding machine known from the prior art.

FIG. 1*a* shows a schematic representation of a braiding machine 1 according to the prior art. The braiding machine 1 has a plurality of bobbins 2, eight in the example shown, as an example of braiding-material carriers. Each of these bobbins 2 serves as a carrier for braiding material to be braided by means of the braiding machine 1 in a braiding centre 3. During operation of the braiding machine 1, the braiding material is supplied radially inwards by each bobbin 2 to the braiding centre 3 of the braiding machine 1. The braiding centre 3 can also be termed the braiding axis of the braiding machine and correspond to the longitudinal axis of the braiding machine 1 or lie parallel to this. According to the example from FIG. 1, the braiding centre 3 corresponds to the centre point of the circular track on which the bobbins 2 move around the braiding centre 3. In operation the bobbins 2 rotate at constant speed around the braiding centre/the braiding axis 3. The braiding material supplied is braided together in a manner known from the prior art by the rotation of the bobbins 2 around the rotating and braiding centre 3 and the removal of the respective braiding material along the braiding centre 3.

According to the schematic representation from FIG. 1*a*, the bobbins 2 are carried by a bobbin carrier 2*a*. By rotation of the bobbin carrier 2*a* and thus movement of the bobbins 2 around the common braiding centre 3, a braiding process can be carried out. In addition, an immobile bobbin (not shown) can be provided, so that the braiding material provided by the plurality of bobbins 2 and the braiding material provided by the immobile bobbin are braided with one another in a known manner. Alternatively it is conceivable for the plurality of bobbins 2 to be arranged on a first bobbin carrier 2*a*, for example an upper ring, and for other bobbins 2 to be arranged on a second bobbin carrier (not shown), for example a lower ring. In this case a braiding process can take place in a known manner by opposed movement, e.g. opposed rotation, of the two common bobbin carriers, for example.

Figure 1B:
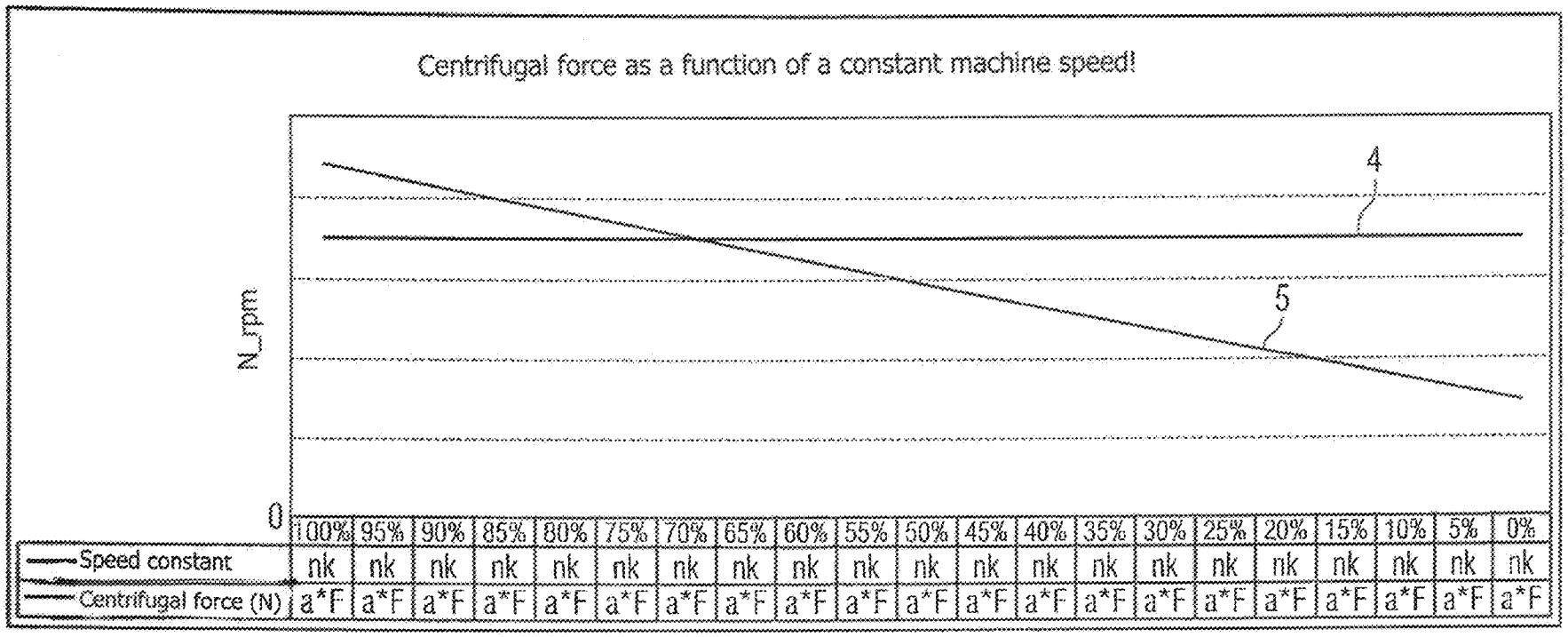
FIG. 1*b* a curve of centrifugal force and speed in the braiding machine from FIG. 1*a;*

In braiding machines known from the prior art, such as the braiding machine 1, a constant speed is set. This speed is selected so that a maximum load of the braiding machines is not exceeded. Known braiding machines are often limited to a maximum speed of 175 rpm and are operated at this maximum speed. At a maximum filling level of 100% of the bobbins 2, a permitted centrifugal force of 221.43 N thus acts on each full bobbin 2. FIG. 1B illustrates how, at a constant speed (see the speed curve 4) and a filling level of 100%, the centrifugal force (see the centrifugal force curve 5) is maximal and decreases as the filling level of the bobbin 2 decreases. This means that the highest load arises with a completely full/filled bobbin 2. As the filling level of the bobbin 2 decreases, the centrifugal force and thus the load on the braiding machine 1 become steadily smaller. This has the consequence that, although braiding machines from the prior art seek to prevent overload of the braiding machine 1, they are not optimised to the desired extent for maximum productivity.

Figure 2:
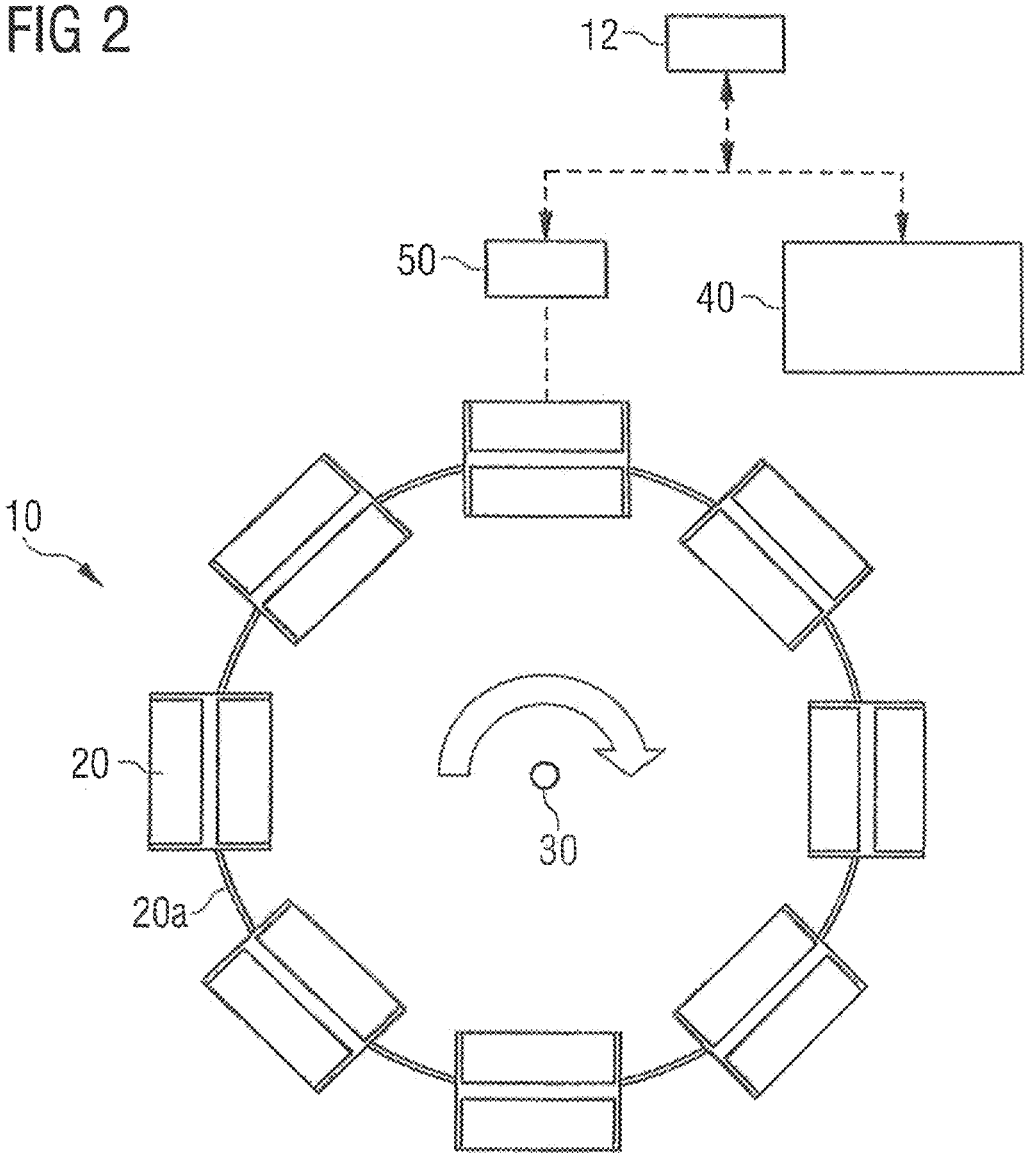
FIG. 2 a first exemplary embodiment of a braiding machine.

FIG. 2 shows a first exemplary embodiment of a braiding machine 10. The basic structure of the braiding machine 10 is based on the structure of the braiding machine 1 from FIG. 1*a*, so that reference is made to the statements regarding this. The bobbin carrier 20*a* from FIG. 2 can thus be a common bobbin carrier for carrying out the braiding process or one of two opposed bobbin carriers, for example an upper ring or a lower ring, the other one of which is not shown in FIG. 2.

The braiding machine 10 from FIG. 2 has bobbins 20 as an example of braiding-material carriers. Each of the bobbins 20 serves as a carrier for braiding material to be braided. The bobbins 20 are rotated by a drive 12 of the braiding machine 10 around a common braiding axis 30/around a common braiding centre 30, which corresponds to the centre of rotation of the bobbins 20 according to FIG. 2. In contrast to the braiding machine 1 from FIG. 1*a*, however, no speed is preselected and kept constant on the braiding machine 10 from FIG. 2. On the contrary, on the braiding machine 10 from FIG. 2 a centrifugal force acting on one or more of the bobbins 20 and contingent on the rotation is kept constant.

The braiding machine 10 has a control device 40 and a sensor 50 for this purpose. The sensor 50 detects repeatedly, e.g. continually, the filling level of one or more of the bobbins 20. The sensor 50 is designed, for example, as a distance sensor for this. The sensor 50 can detect the respective distance to the bobbins 20 passing by, for example by means of laser. Since the filling level of the bobbins 20 constantly changes, the distance detected by the sensor 50 also changes accordingly. It is assumed below by way of example that the sensor 50 repeatedly detects the filling level of all bobbins 20. The mass of each of the bobbins 20 can be determined from this either directly by the sensor 50 or by the control device 40.

Alternatively or in addition to the configuration of the sensor e.g. as a distance sensor for detecting the filling level of the bobbins 20 and the indirect determination of the mass of the bobbins 20 from the detected filling level, each bobbin 20 can be provide with a force sensor, for example. The centrifugal force acting in each case can then by measured directly by means of the force sensor. This means that, alternatively or additionally (e.g. for reasons of redundancy) to the sensor 50, a sensor can be provided at each of the bobbins 20, which directly measures the centrifugal force acting on the bobbin 20.

Independently of the precise determination of the mass, the centrifugal force acting on the respective bobbin 20 can be determined by the control device 40 from the mass of a bobbin 20 with a knowledge of its radial distance r from the centre of rotation, i.e. from the braiding centre 30. From the mass of each bobbin 20 the control device can deduce the acting centrifugal force in principle for each bobbin 20. The centrifugal force F results from the angular velocity co as follows:

$$F=m*\omega^2*r$$

The angular velocity co is directly proportional to the speed n, as the following applies:

$$\omega=2*n$$

Thus the following results for the connection between centrifugal force F and speed n:

$$F=4*n^2*n^2*m*r$$

The number n (Pi) is known and constant. The mass m and centrifugal force F act in a directly proportional manner. This means that as mass decreases, the centrifugal force F acting on a body decreases in direct proportion. Due to this, in the case of a decreasing filling level and thus decreasing mass m of the bobbins 20, the speed n can be increased accordingly and the acting centrifugal force nevertheless kept constant. The control device 40 determines the speed n such that the centrifugal force F acting on the bobbins 20 remains constant. The speed n of the braiding machine 10 can thereby be increased with the decrease in the bobbin filling level. This increases productivity. Let it be stated here purely by way of example that the speed can be adjusted in a range from 150 rpm to 250 rpm or in a sub-range from this during the braiding process.

In the example from FIG. 2, the filling level of all bobbins 20 is identical purely as an example. This can occur in practice, for example, when the braiding machine 10 is first commissioned or when all bobbins 20 are exchanged at the same time and replaced by completely filled bobbins 20. In this case it is sufficient if only the filling level of one of the bobbins 20 is detected. Alternatively the filling level of all bobbins 20 can be detected. Regardless of this, it is sufficient at any rate according to this example to know the mass of one of the bobbins 20 on the part of the control device 40 and to take it into account for control. In this case, based on the determined mass m of one of the bobbins 20 and thus with sufficient accuracy the mass m of each of the bobbins 20, the control device 40 will adjust the speed n such that, as the mass m of the bobbin(s) 20 decreases, the centrifugal force F remains constant. The speed n can be determined from the above formula by the following dependence:

$$n^2=F/(4*n^2*m*r)$$

Not only is the speed or the speed adjustment a quadratic function, but also the mass of the bobbin 20 or the loss of mass of the bobbin during production/during the braiding process (the mass and the loss of mass are proportional to $n/4*(D^2-d^2)$). D is the outer diameter of the bobbin at maximum bobbin filling. D decreases during the braiding process and is therefore not constant. d is the core diameter of the bobbin itself and is therefore constant. Thus d can also be understood as the diameter of the bobbin without fill material. In this way it is possible to determine from the known proportionality the loss of mass from the outer diameter of the bobbin 20 with the bobbin filling present in each case and the constant diameter of the bobbin 20 without fill material.

Figure 3:
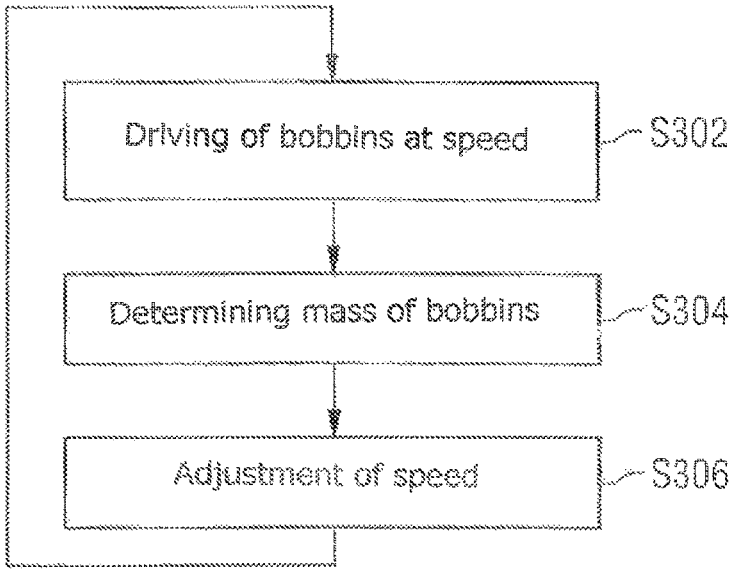
FIG. 3 a flow chart of an exemplary embodiment of a method for controlling the braiding machine from FIG. 2.

Further details regarding the control of the braiding machine 10 are now described in relation to FIG. 3.

In a step S302, the drive of the braiding machine 10 drives the bobbins 20 such that they move around the common braiding centre 30, e.g. rotate. They can rotate e.g. at an adjustable speed n around the braiding centre 30. In steps S304 and S306 the drive is controlled such that a centrifugal force acting on at least one of the bobbins 20 remains at least nearly constant. For this the filling level of the bobbins 20 is first detected by means of the sensor 50 in step S304. In addition, based on the respectively detected bobbin filling level, a mass of the bobbin 20 and thus of each of the at least nearly identically filled bobbins 20 is determined by the control device 40 in step S304. The determined mass of the bobbin 20 can now be used to determine an adjusted speed with the aid of the relationship $$n^2=F/(4*n^2*m*r)$$

From this relationship the control device 40 can directly determine the adjusted speed n in step S306, as the radial distance r to the braiding centre 30 is known and constant, the mass m has been determined and the centrifugal force F is kept constant. This means that for the latter, the previously existing value, which was selected at the start for the braiding machine 10, for example, is used.

In step S302 the braiding machine 10 is driven at the adjusted speed n. Steps S302 to S306 can be repeated e.g. continually during the braiding process.

Figure 4:
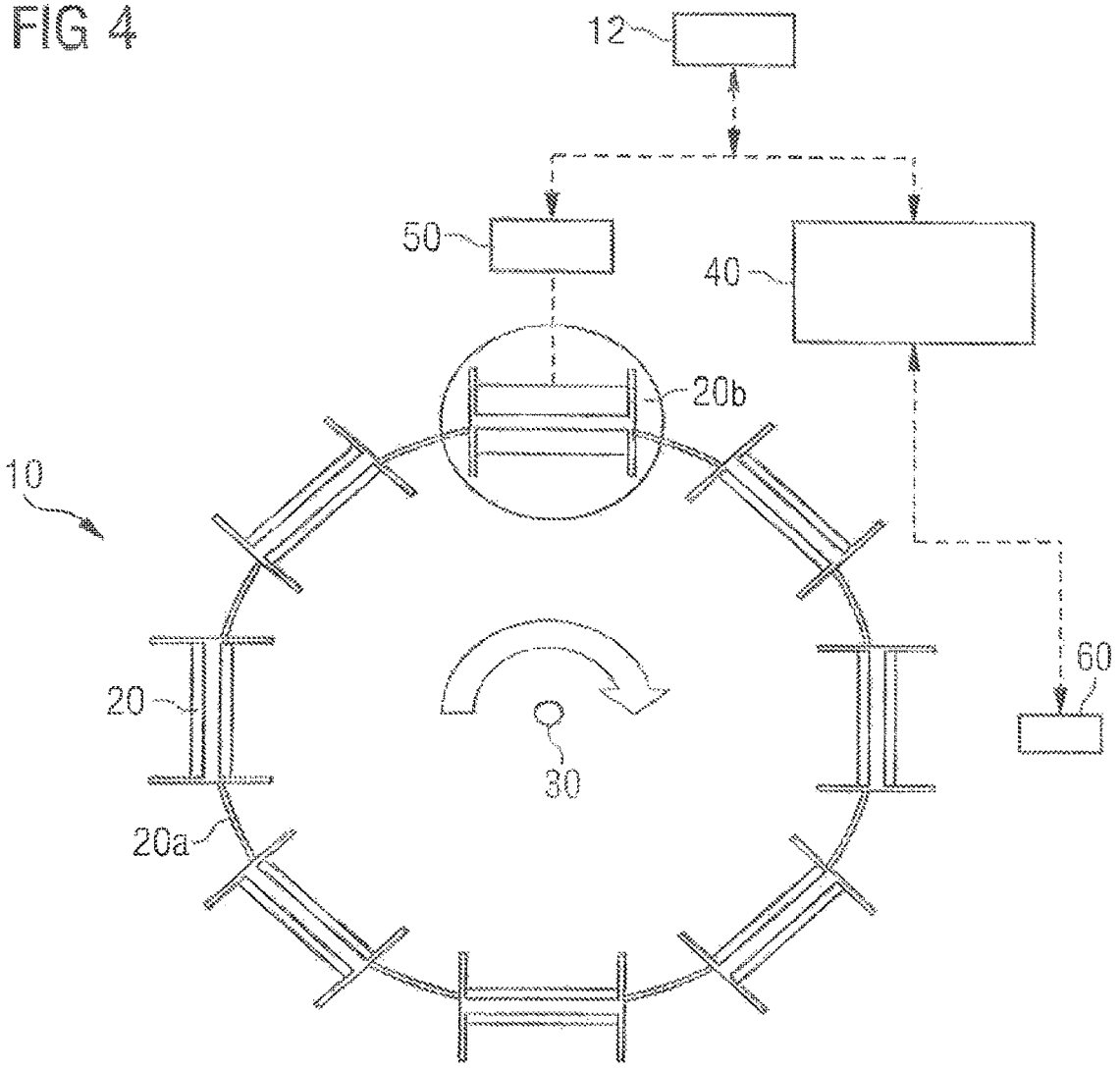
FIG. 4 a second exemplary embodiment of a braiding machine.

A second exemplary embodiment of the braiding machine 10 is shown in FIG. 4. The braiding machine 10 from FIG. 4 is based on the braiding machine 10 from FIG. 2. Identical reference signs are used accordingly for the identical elements and the braiding machine is also described using the same reference sign. The braiding machine 10 from FIG. 4 has a slightly adapted algorithm. The braiding machine 10 from FIG. 4 can optionally also have an unbalance sensor 60. As indicated in FIG. 4, the bobbins 20 of the braiding machine 10 have a different filling level at least in some cases, purely as an example.

The adapted algorithm is adjusted so that the filling level of all bobbins 20 is detected by means of the sensor 50 (this corresponds to a possible procedure from FIG. 2), but to determine the speed only the filling level of the maximally filled bobbin 20*b* and thus the maximal mass of all bobbins 20 is considered. Expressed another way, the adjustable speed is determined from the filling level of the bobbin 20*b* with the maximum filling level and thus of the bobbin 20*b* with the maximum mass. If one of the bobbins 20 is exchanged, the bobbin 20*b* of maximum mass can change.

The control device 40 can use the greatest mass m_max of the determined masses m to determine the adjusted speed as follows.

From the relationship $$F=4*n^2*n^2*m_\max*r$$

the control device 40 can determine the adjusted speed n directly, as the radial distance r to the braiding centre 30 is known and constant, the greatest mass m_max is known and the centrifugal force F is kept constant. This means that for the latter the previously existing value, which was selected at the beginning for the braiding machine 10, for example, is used.

In addition, an imbalance in the braiding machine 10 can be determined by means of the unbalance sensor 60. This imbalance results from the different filling level and thus the different mass of the bobbins 20. Since the imbalance increases as the speed rises, this can be optionally monitored. The control device 40 can take account of the imbalance when adjusting the speed n. It is e.g. conceivable that it is established with the aid of the unbalance sensor 60 that a maximally permissible imbalance is exceeded if the speed determined by the control device were/is used. The control device 40 can then reduce the speed such that the maximally permissible imbalance is not exceeded.

FIGS. 5*a* to 5*d* illustrate the advantages of the braiding machines 10 from FIGS. 2 and 4.

Figure 5A:
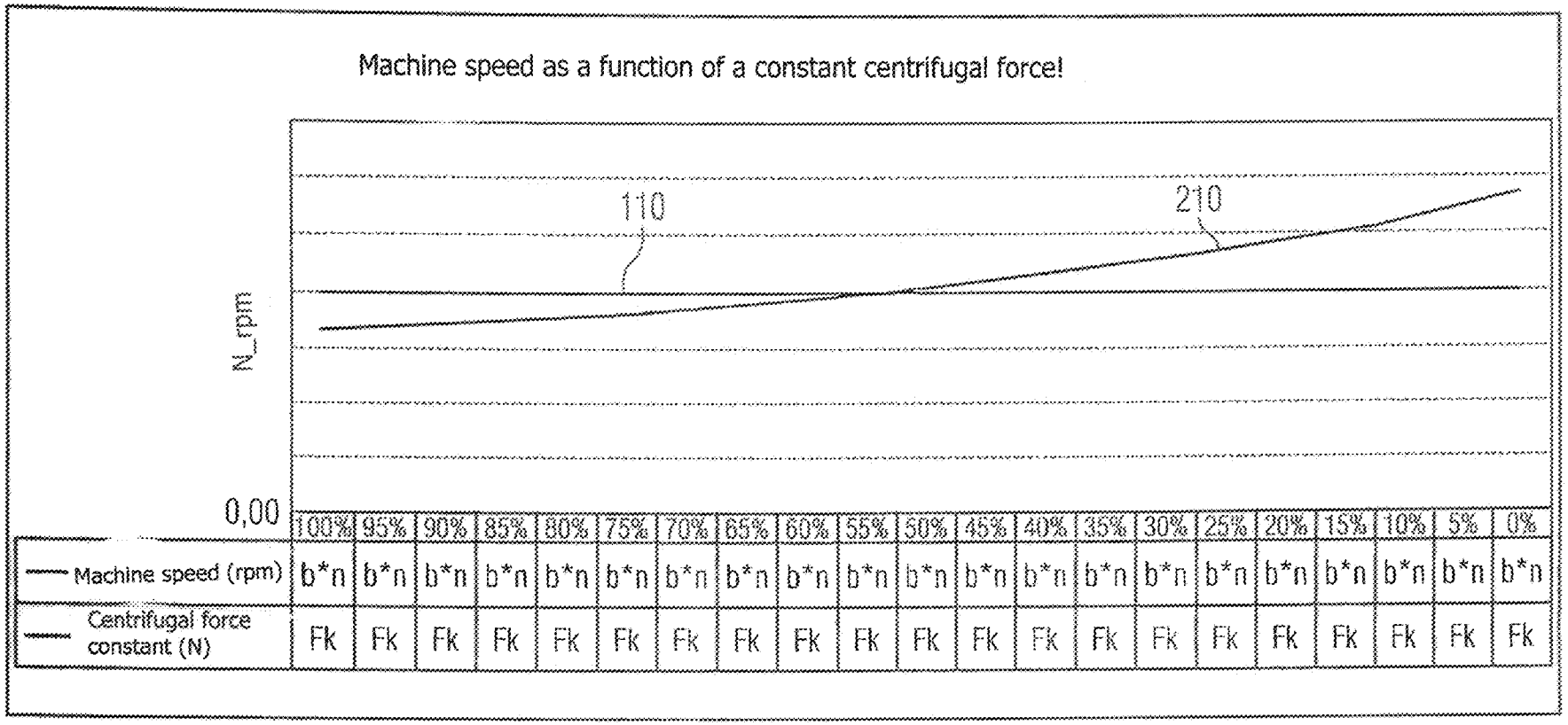
FIG. 5*a* a curve of machine speed and centrifugal force in a braiding machine from FIGS. 2 and 4.

As is recognisable from FIG. 5*a*, the centrifugal force is kept constant on the braiding machines 10 from FIGS. 2 and 4 (see the curve 110 of the centrifugal force Fk). This has the consequence that as the filling level of the bobbins 20 decreases (from 100% to 0%), the possible speed increases (see the curve 210 of the speed; rising curve illustrated by multiplication of speed n by a variable value b>1).

Figure 5B:
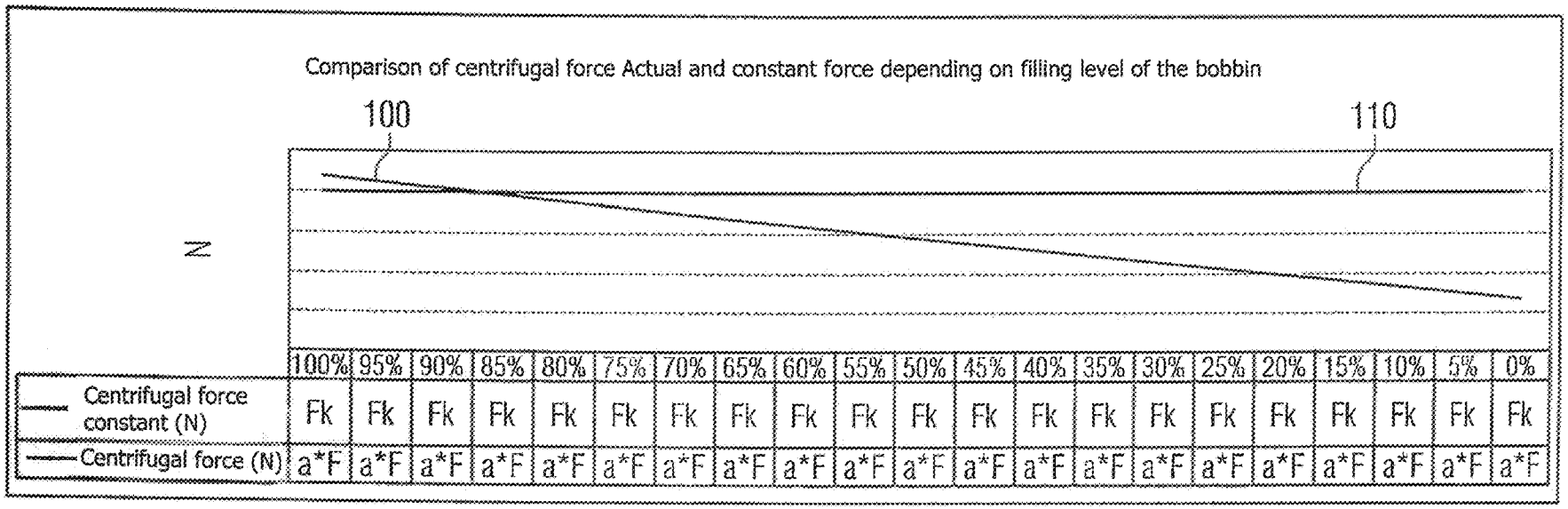
FIG. 5*b* a comparison of the centrifugal force of the braiding machine from FIG. 1 and the centrifugal force of the braiding machines from FIGS. 2 and 4.

FIG. 5*b* shows the curve 110 of the centrifugal force of the braiding machines 10 of FIGS. 2 and 4 compared with the curve 100 of the centrifugal force on the braiding machine 1 from FIG. 1*a*. It is to be recognised that the centrifugal force on the braiding machines 10 remains constant independently of the filling level of the bobbins 20 (constant centrifugal force Fk), while the centrifugal force of the braiding machine 1 decreases as the filling level decreases (decreasing curve illustrated by multiplication of centrifugal force F by a constant value a<1).

Figure 5C:
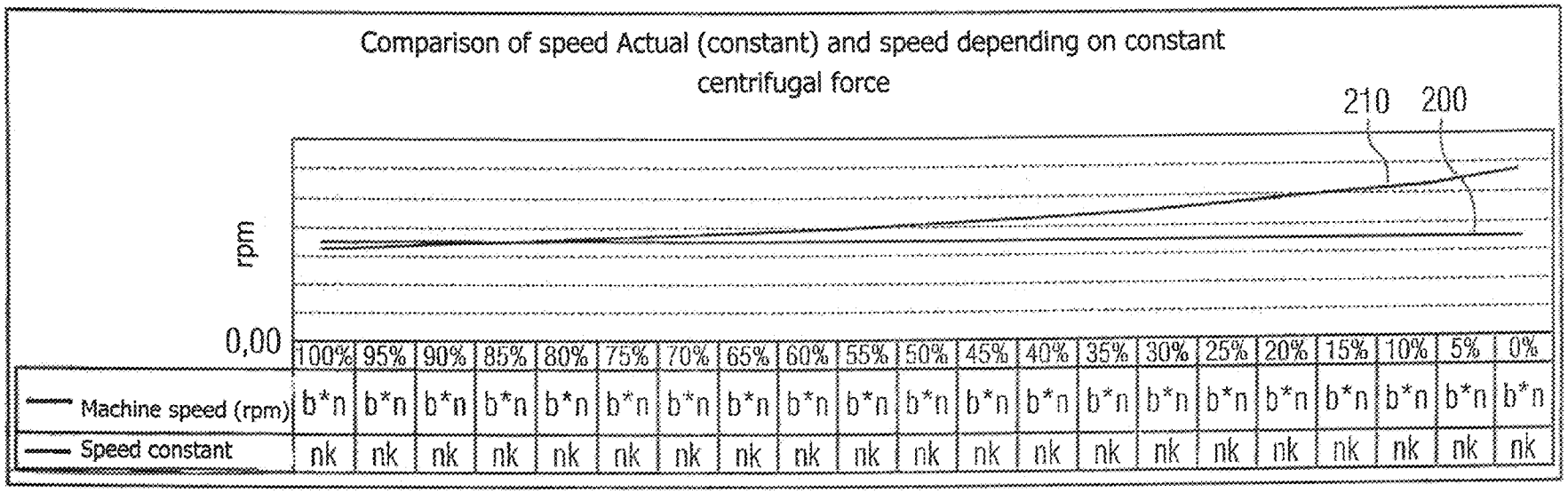
FIG. 5*c* a comparison of the speed of the braiding machine from FIG. 1 with the speed of a braiding machine from FIGS. 2 and 4.

In FIG. 5*c*, the curve 210 of the speed on the braiding machines 10 from FIGS. 2 and 4 is compared with the curve 200 of the speed on the braiding machine 1 from FIG. 1*a*. As is to be recognised, at the maximum filling level of 100% the speed of the braiding machines 10 is slightly below the speed of the braiding machine 1 purely as an example. Already at a filling level of approx. 85%, the two filling levels approximate to one another and are at least nearly identical. From a filling level of 80% onwards the speed of the braiding machines 10 is already greater than the speed of the braiding machine 1. For a majority of the braiding process the braiding machine 10 from FIGS. 2 and 4 can thus be operated at a higher speed than the braiding machine 1 from FIG. 1*a*. This increases productivity. The starting speed of the braiding machines 10 can already be at or higher than the speed of the braiding machine 1.

Figure 5D:
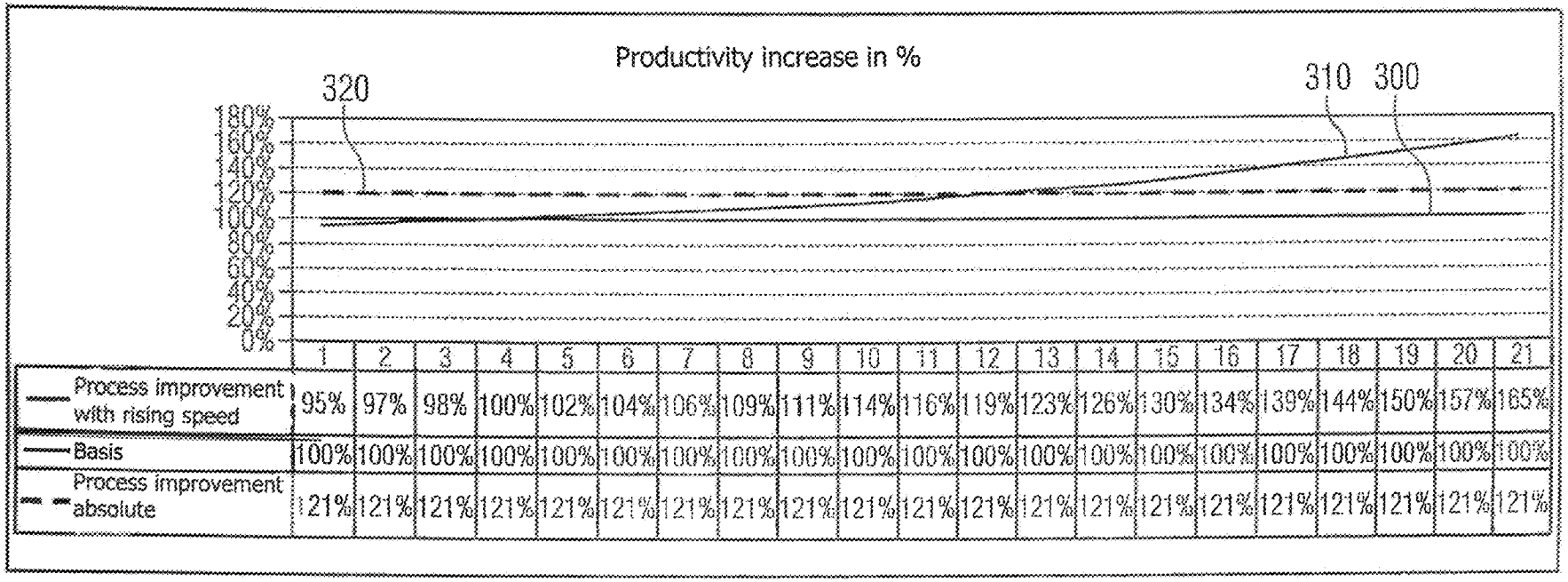
FIG. 5*d* the productivity increase in percent when using a braiding machine from FIGS. 2 and 4 as compared with a braiding machine from FIG. 1.

The extent of the productivity increase results purely by way of example from FIG. 5*d*. The curve 300 of the productivity of the braiding machine 1 is constant regardless of the filling level of the bobbins 2, as the speed is constant. On the other hand, the curve 310 of the productivity on the braiding machines 10 rises as the filling level of the bobbins 20 decreases. At a filling level of 100% down to below 85%, the productivity of the braiding machines 10 is still slightly lower than on the braiding machine 1, but at a filling level of 85% the productivity converges. The braiding machines 10 can alternatively even start immediately at the maximum permissible speed. Thus a productivity increase would be achieved immediately (on start-up of the braiding machines 10). As the filling level decreases from under 85% to 0%, the productivity advantage of the braiding machines 10 compared with the braiding machine 1 rises ever further. Alternatively, after reaching a certain limit speed, the braiding machine 10 could be operated at a constant speed until reaching the empty status (filling level 0%). The curve 320 of productivity averaged over the braiding process shows that the averaged productivity of the braiding machines 10 is above the constant productivity of the braiding machine 1. Averaged over the entire process, a considerable increase in productivity of up to 21% can thus be achieved.

The invention claimed is:

1. A braiding machine, having:

a first set of braiding-material carriers, which are arranged at a first uniform radial distance from a common braiding centre of the braiding machine around the common braiding centre of the braiding machine and are each designed to carry a braiding material to be braided in the common braiding centre;

a second set of braiding-material carriers, which are arranged at a second uniform radial distance from the common braiding centre of the braiding machine around the common braiding centre of the braiding machine and are each designed to carry a braiding material to be braided in the common braiding centre;

a drive, which is designed to drive at least the first set of braiding-material carriers such that they move around the common braiding centre;

a control device, which is designed to control the drive by adjusting an adjustable angular velocity or velocity around the common braiding centre such that during a braiding process, a centrifugal force acting on at least one of the braiding-material carriers remains at least nearly constant; and at least one unbalance sensor, which is designed to determine an imbalance of at least the first set of braiding-material carriers on rotation around the common braiding centre;

wherein the control device is designed to take account of the determined imbalance in the control of the drive.

2. The braiding machine according to claim 1, wherein the drive is designed to drive at least the first set of braiding-material carriers such that they rotate around the common braiding centre at an adjustable speed, and the control device is designed to adjust the adjustable speed to an adjusted speed such that a centrifugal force acting on at least one of the braiding-material carriers remains at least nearly constant.

3. The braiding machine according to claim 2, wherein the control device is designed to control the drive of the braiding machine such that at least the first set of braiding-material carriers rotate around the common braiding centre at the adjusted speed.

4. The braiding machine according to claim 2, wherein the control device is designed to adjust the adjustable speed repeatedly during a braiding process.

5. The braiding machine according to claim 1, wherein the control device is designed to control the drive such that a centrifugal force acting maximally on at least one of the braiding-material carriers remains at least nearly constant.

6. The braiding machine according to claim 1, wherein the control device is designed to control the drive as a function of the mass of at least one of the braiding-material carriers carrying the braiding material.

7. The braiding machine according to claim 1, wherein the control device is designed to control the drive as a function of the mass of the braiding-material carrier with the greatest mass of at least the first set of braiding-material carriers.

8. The braiding machine according to claim 1, further having at least one sensor, which is designed to detect a filling level of at least one of the braiding-material carriers with braiding material.

9. The braiding machine according to claim 8, wherein the at least one sensor is designed to detect a filling level of the at least one braiding-material carrier repeatedly during a braiding process.

10. The braiding machine according to claim 8, wherein the control device is designed to deduce the mass of the at least one braiding-material carrier from the detected filling level of the at least one braiding-material carrier.

11. The braiding machine according to claim 2, wherein the control device is designed to adjust the adjustable speed such that the adjustable speed rises linearly during a braiding process.

12. The braiding machine according to claim 11, wherein the adjustable speed rises linearly during a braiding process as a function of a fixed setting in the braiding machine.

13. The braiding machine according to claim 11, wherein the adjustable speed rises linearly during a braiding process as a function of the mass of at least one of the braiding-material carriers.

14. The braiding machine according to claim 11, wherein the adjustable speed rises linearly during a braiding process as a function of the filling level of at least one of the braiding-material carriers.

15. A method for controlling a braiding machine, wherein the braiding machine has a first set of braiding-material carriers, a second set of braiding-material carriers, a drive, a control device, and at least one unbalance sensor, which is designed to determine an imbalance of at least the first set of braiding-material carriers on rotation around the common braiding centre, wherein the control device is designed to take account of the determined imbalance in the control of the drive, wherein the first set of braiding-material carriers are arranged at a first uniform radial distance from a common braiding centre of the braiding machine around the common braiding centre of the braiding machine and are each designed to carry a braiding material to be braided in the common braiding centre, wherein the second set of braiding-material carriers are arranged at a second uniform radial distance from the common braiding centre of the braiding machine around the common braiding centre of the braiding machine and are each designed to carry a braiding material to be braided in the common braiding centre, wherein the method has the steps:

driving of at least the first set of braiding-material carriers such that they move around the common braiding centre; and controlling of the drive by adjusting an adjustable angular velocity or velocity around the common braiding centre such that during a braiding process, a centrifugal force acting on at least one of the braiding-material carriers remains at least nearly constant.

16. The braiding machine according to claim 2, wherein the control device is designed to adjust the adjustable speed continuously during a braiding process.

17. The braiding machine according to claim 8, wherein the at least one sensor is designed to detect the filling level of the least one braiding-material carrier continuously during a braiding process.

* * * * *